US007210409B2

(12) United States Patent
Johnson

(10) Patent No.: US 7,210,409 B2
(45) Date of Patent: May 1, 2007

(54) MODULAR EXPLOSIVES CARTRIDGE AND NOVEL SPIDER CONSTRUCTION

(75) Inventor: Richard John Johnson, Dolphin Heads (AU)

(73) Assignee: Johnson Hi-Tech (Australia) Pty., Wanneroo (AU)

( * ) Notice: Subject to any disclaimer, the term of this patent is extended or adjusted under 35 U.S.C. 154(b) by 224 days.

(21) Appl. No.: 10/769,033

(22) Filed: Jan. 30, 2004

(65) Prior Publication Data

US 2005/0126419 A1 Jun. 16, 2005

(30) Foreign Application Priority Data

Feb. 3, 2003 (AU) ..... 2003900435

(51) Int. Cl.
*F42B 3/02* (2006.01)

(52) U.S. Cl. ..... 102/317; 102/319; 102/313; 102/331; 102/321

(58) Field of Classification Search ..... 102/317, 102/319, 320, 313, 314, 315, 331, 332
See application file for complete search history.

(56) References Cited

U.S. PATENT DOCUMENTS

| | | | | | |
|---|---|---|---|---|---|
| 3,185,091 | A | * | 5/1965 | Hamilton | 102/317 |
| 3,504,628 | A | * | 4/1970 | Hatton-Ward et al. | 102/317 |
| 3,926,119 | A | * | 12/1975 | Hurst et al. | 102/501 |
| 3,949,673 | A | | 4/1976 | Lyerly | |
| 4,000,696 | A | * | 1/1977 | Friant et al. | 102/331 |
| 4,294,171 | A | * | 10/1981 | Ducharme | 102/317 |
| 4,348,955 | A | * | 9/1982 | Rowley et al. | 102/317 |
| 4,546,703 | A | * | 10/1985 | Thompson | 102/333 |
| 4,961,381 | A | * | 10/1990 | McLaughlin | 102/319 |
| 5,343,002 | A | * | 8/1994 | Gremillion | 181/116 |
| 5,410,966 | A | * | 5/1995 | Dorffler et al. | 102/202 |
| 5,435,250 | A | * | 7/1995 | Pollock | 102/317 |
| 5,831,197 | A | * | 11/1998 | Bill et al. | 86/23 |

FOREIGN PATENT DOCUMENTS

| | | | |
|---|---|---|---|
| AU | B-21624/77 | | 8/1978 |
| AU | A-33390/84 | | 3/1985 |
| AU | A-81802/87 | | 5/1988 |
| AU | A-10705/92 | | 8/1992 |
| AU | 742653 | | 8/1999 |
| CA | 2163694 | A * | 5/1997 |
| GB | 882665 | | 11/1961 |
| GB | 1 281 421 | | 7/1972 |
| GB | 2132319 | A * | 7/1984 |
| WO | WO 99/45337 | | 9/1999 |
| WO | WO 99/46556 | * | 9/1999 |
| WO | WO 03/004960 | A1 * | 1/2003 |

* cited by examiner

*Primary Examiner*—James S. Bergin
(74) *Attorney, Agent, or Firm*—Workman Nydegger

(57) ABSTRACT

A modular explosives cartridge comprises a tubular body having lockable coupling members secured on opposite ends thereof to form a bayonet coupling between opposite ends of respective cartridges to form an elongate tubular explosives cartridge. The lockable coupling members each include a sealing membrane to form a sealed closure at opposite ends of the tubular body, the sealing membranes being pierced during coupling to form a continuous column of explosive composition within said elongate tubular cartridge.

12 Claims, 5 Drawing Sheets

MODULAR EXPLOSIVES CARTRIDGE AND NOVEL SPIDER CONSTRUCTION

FIELD OF THE INVENTION

THIS INVENTION relates to modular elongate explosives charges and in particular for use in overhead stope blasting.

BACKGROUND OF THE INVENTION

It is well known to package explosive compositions in purpose designed packages to assist in transportation and handling of explosives compositions including dry powder or granulated compounds, emulsions, slurries, water gels and the like.

These packages may be adapted to suit charge mass, borehole diameter, borehole length and the like.

Australian Patent Application AU-A-81802/87 describes the packaging, in non-porous plastic cartridges of from 25 mm to 75 mm in diameter and 1000 mm length, an explosive composition comprising ammonium nitrate, paraffinic oil and foamed or expanded polystyrene beads.

British Patent 882665 describes the packaging of ammonium nitrate compositions in paper wrapped cartridges.

British Patent 1281421 also describes packaging of an ammonium nitrate explosive in a thin flexible plastic sheath such as polyethylene. This product has detonating cord extending throughout an elongate explosive filled sheath in a unitary charge of up to 20 m long. The specification discloses divisible charges in rolls of from 50 m to 100 m in length whereby charges of selected shorter length can be formed by clamping the sheath at closely spaced intervals and severing the charge therebetween.

The patent specification states that explosive charges according to the invention can be inserted into boreholes at up to 60° from vertical and moreover that with the aid of a bracket shaped slide, these packages can be inserted into horizontal boreholes.

Experience has shown however that thin flexible sheaths of say 0.2 mm in wall thickness are prone to perforation by puncture on rough borehole surfaces or by abrasion even on smooth borehole surfaces. If such perforations occur near the lower end of the charge being inserted, there is a risk that a substantial part of the freely flowing particulate explosive composition would fall to the bottom of the borehole beyond the end of the detonating cord without the knowledge of the personnel concerned. Only when the connected charges in adjacent boreholes were detonated would it be discovered that the mechanical and safety aspects of the integrated breaking pattern were compromised by the detonation failures in one or more boreholes.

These soft thin walled explosive packages were found to be difficult and time consuming to insert in to horizontal boreholes and even more prone to puncture and tearing when pushed into the horizontal cavity.

A particular difficulty with such flexible, thin walled elongate explosive charges is that when rolled into conveniently sized coils for packaging, transportation and storage, the tubular sheath is prone to kinking or flattening in parts.

At the position of the kink or flattened region, the cross sectional area of the explosive charge is substantially diminished and with severe kinking, a discontinuity may be formed in the mass of explosive material. This kinking or cross sectional area reduction can also occur when trying to insert elongate thin walled flexible tubular explosive charges into inclined or horizontal boreholes.

It is believed that severe reductions in cross sectional area or discontinuity in the mass of explosive composition may give rise to a condition known as "gapping" where propagation of explosive energy along the charge column is interrupted.

In order to overcome such problems with prior art packaged explosives, particularly for use in perimeter hole blasting for tunnel shaping where the boreholes are horizontally drilled, it has been proposed to use short, ridged tubular packages adapted for end to end coupling to form a long unitary charge.

Originally such explosive packages comprised a stiff paper or cardboard cylinder about 900 mm long and about 20 mm diameter filled with highly viscous, non flowable cap sensitive emulsion explosive. The paper or cardboard cylinder was open at opposite ends which were shaped to form a socket and spigot engagement between adjacent packages.

Of more recent times these paper or cardboard cylinders have been replaced with a semi rigid plastic tube such as polyethylene with wall thickness of about 1 mm.

A difficulty encountered with these prior art modular explosives tubes is that a close face to face abutment of the explosive composition in adjacent tubes is required to ensure propagation of the explosive force throughout the entire assembly which may for example comprise six tubes frictionally engaged by the socket and spigot fittings.

As typically these tubes are initially filled with a heated mix to reduce viscosity of the normal non-flowable viscous emulsion, the tube contents undergo shrinkage on cooling and can create a gap of 2–3 mm between the faces of explosive material when the tubes are joined.

Where "gapping" occurs between adjacent explosive masses, whether due to shrinkage in the tube or human error in assembly, an incomplete explosion can leave one or more portions of the explosive charge in the ground. This is an extremely hazardous situation with cap sensitive explosives in particular, which may be accidentally detonated by impact from an excavator or subsequently in a crushing mill.

Another problem associated with prior art blasting techniques is that where it is required to increase the powder factor or energy factor in the "butt" or base of a borehole, it is common practice to first push a separate primer charge to the butt of the borehole.

Thereafter, a water gel or emulsion explosive is loaded into the borehole typically in a form of a spigot and socket joined tube described above.

Again this procedure is prone to unreliability due gapping between the primer and the end of the explosive charge and/or between adjacent tubes which can lead to ineffectual blasting, rifling of the borehole and unexploded explosives left in the borehole.

Yet another disadvantage associated with abovementioned prior art explosive charge is the need to insert a stem plug to close off the borehole after the charge is loaded. This a costly and time consuming process.

Australian Patent 742653 to the same inventor describes an elongate coilable blasting cartridge having a detonating cord extending longitudinally within the tubular casing and terminating in a distal end of enlarged diameter compared with the main part of the tubular casing. This product is available in 4–5 meter lengths and addresses many of the prior art problems referred to above.

Although the coilable elongate blasting cartridge described in Australian Patent No 742653 is not prone to gapping, there exists a need for a modular blasting cartridge construction capable of forming variable cartridge lengths as required but which still has the reliability of the product of Australian Patent No 742653.

SUMMARY OF THE INVENTION

It is an aim of the present invention to overcome or ameliorate at least some of the prior art problems associated with modular explosive tubular containers and/or otherwise to provide users with a convenient choice.

According to one aspect of the invention there is provided a modular explosives cartridge, said cartridge comprising:

a tubular body having lockable coupling members secured on opposite ends thereof, said lockable coupling members each including a sealing membrane, in use, to form a sealed closure at opposite ends of said body to an explosive composition contained within said tubular body, said lockable coupling members, in use, being adapted to engage with a lockable coupling member of an adjacent explosives cartridge whereby adjacent sealing membranes of respective coupling members are pierced to form a continuous column of explosive composition extending between opposite ends of the coupled explosives cartridges.

Suitably, said coupling members comprise socket and spigot members secured on opposite ends of said tubular body.

If required, said socket and spigot members may be adapted for releasable engagement with a respective socket or spigot member of an adjacent cartridge.

Preferably, said socket and spigot members together form a bayonet coupling.

The socket and spigot members each include at least one piercing member adapted to pierce a sealing membrane associated with an adjacent explosives cartridge during coupling of adjacent cartridges.

Preferably, said at least one piercing member comprises an axially extending blade.

Most preferably, said socket and spigot members each include a pair of diametrically opposed blades.

If required, said at least one piercing member may have a sharpened edge to cut said sealing member of a respective adjacent cartridge during coupling of respective socket and spigot members.

Alternatively, said at least one piercing member may be adapted to tear said membrane during coupling of respective socket and spigot members.

The coupling members may be secured to said tubular body by fusion or by an adhesive composition.

Alternatively, said coupling members may be secured to said tubular body by mechanical engagement therebetween.

Suitably, said coupling members comprise barbed tubular members frictionally engageable with an interior and/or exterior surface of said tubular body.

If required, said coupling members are identified by visual identifiers to assist in manufacture of and subsequent coupling of said modular charges.

Preferably said identifiers comprise colour coding of said coupling members.

According to another aspect of the invention there is provided a method of assembly of a modular explosives cartridge, said method comprising the steps of:

coupling together a predetermined number of modular explosives cartridges according to a first aspect of the invention, said modular cartridges, in use, being coupled in end to end relationship before being inserted as a unitary member into a borehole.

According to a still further aspect of the invention there is provided a method of charging an explosives borehole with an elongate explosives cartridge comprising a plurality of coupled modular cartridges according to a first aspect of the invention, said method comprising the steps of inserting portion of a modular cartridge into a borehole, coupling thereto an additional modular cartridge and inserting the assembly further into said borehole and repeating those steps until an elongate explosives cartridge comprising a predetermined number of modular cartridges coupled end to end is located in said borehole.

According to yet another aspect of the invention there is provided an improved spider for locating an elongate tubular explosives cartridge in a borehole, said spider comprising:

a mounting collar, in use securable about an outer surface of an elongate tubular explosives cartridge, said mounting collar supporting a plurality of spaced substantially radially extending fingers, said fingers, in use, being resiliently deformable to accommodate a borehole having a diameter greater than said elongate tubular explosives cartridge and smaller than a diameter of said radially extending fingers in an undeformed state; and, a hollow locator body supported on said mounting collar to locate, in use, a detonator extending partially via an aperture in a wall of said explosives cartridge to an interior region occupied by an explosives composition.

If required, said mounting collar may comprise a retaining band of adjustable length to accommodate tubular explosives cartridges of varying diameters.

Alternatively, said mounting collar comprises a circular member adapted, in use, for frictional engagement on an outer surface of an elongate tubular explosives cartridge.

The mounting collar may comprise a circular member slidably securable over an outer surface of an elongate tubular explosives cartridge, said mounting collar, in use, being anchored to said tubular explosives cartridge by engagement of said detonator extending into said interior region of said cartridge.

Preferably, said hollow locator body has a tubular axis extending, in use, at an acute angle with a longitudinal axis of said elongate tubular explosives cartridge.

If required, said hollow locator body, in use, may comprise a guide to facilitate alignment of a piercing tool to form an aperture in a wall of said explosives cartridge.

Preferably, said piercing tool is adapted, in use, to form a detonator locating cavity in said explosives composition.

According to an additional aspect of the invention there is provided a piercing tool for use with the improved spider according to the above aspect of the invention, said tool comprising a hollow tubular member adapted for slidable engagement into a bore of said hollow locator body, said hollow tubular member including a tapered piercing end adapted, in use, to pierce a wall of said elongate tubular explosives cartridge and to form a cavity in said explosives composition to receive at least portion of a detonator therein.

Preferably, said elongate tubular explosives cartridge is formed by a plurality of coupled modular explosives cartridge elements according to other aspects of the invention.

BRIEF DESCRIPTION OF THE DRAWINGS

In order that the invention may be more readily understood and put into practical effect, the invention will now be described with reference to preferred embodiments illustrated in the accompanying drawings in which.

For the sake of simplicity throughout the drawings, like reference numerals are employed for like features.

DETAILED DESCRIPTION OF THE DRAWINGS

Figure 1:
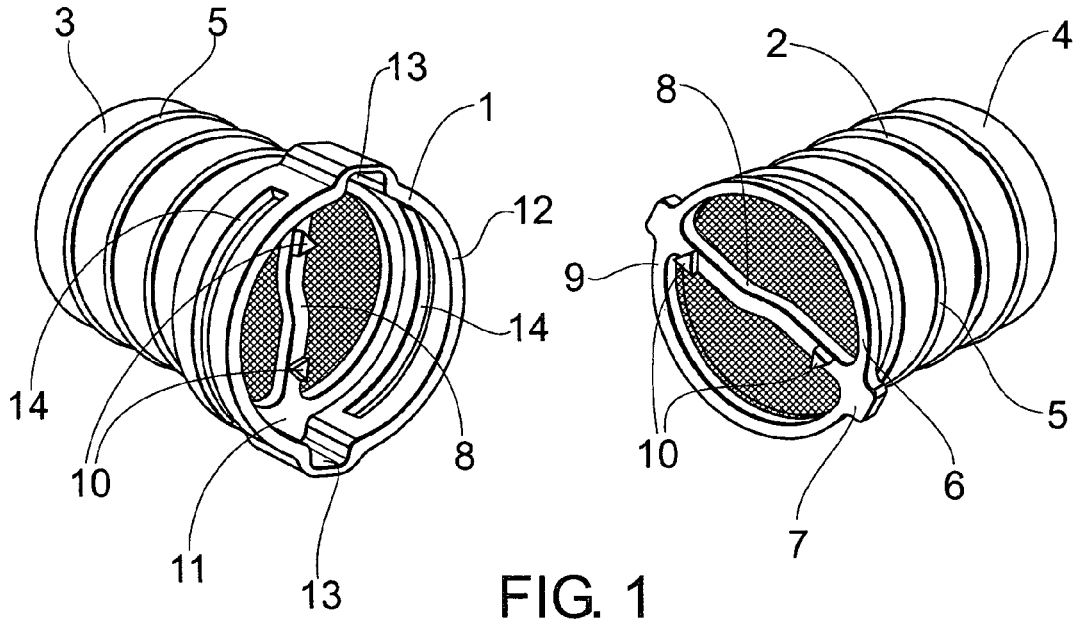
FIG. 1 shows a pair of coupling elements according to one aspect of the invention.

In FIG. 1, the coupling elements comprise a socket element 1 and a spigot element 2, each having a tubular body portion 3,4 respectively about which are spaced circumferential barbed projections 5 to enhance frictional engagement on an inner wall surface of a tubular housing (not shown).

Spigot element 2 has a planar end surface 6 from which diametrically opposed lugs 7 extend radially. A stiffening rub 8 extends across the mouth of the spigot element 2 between lugs 7. The outwardly facing surfaces of the end wall 9 of element 2 and rib 8 are in the same plane and normally support a perforatable membrane (not shown) comprised of a plastics/metal laminate such as Mylar (Trade Mark)/aluminium foil. Extending through the membrane (not shown) are a pair of diametrically opposed perforating blades 10 having a generally triangular cross-section. Blades 10 are supported on rib 8 which is of a generally "S"-shaped configuration to offset opposed blades 10 on either side of a transverse axis upon which lugs 7 lie.

Socket element 1 has a recessed planar circumferential shoulder or land 11 surrounded by a locating collar 12. Circumferential land 11 also includes a generally "S"-shaped stiffening rib 8 upon which perforating blades 10 are located. The outwardly facing surfaces of land 11 and rib 8 are coplanar and normally have a perforatable membrane (not shown) secured thereto with blades 10 extending therethrough in the same manner as spigot member 2.

Socket element 1 has a pair of diametrically opposed locating recesses 13 which, in use, locate lugs 7 of spigot element 2 whereby the planar end surface of spigot element 2 abuts the generally complementary planar configurational shape of land 11 and rib 8.

On opposite sides of collar 12 are slotted apertures 14 which communicate at one end with a respective recess 13 and terminate at a position about 150°–160° from the centre of a respective recess 13.

Figure 2:
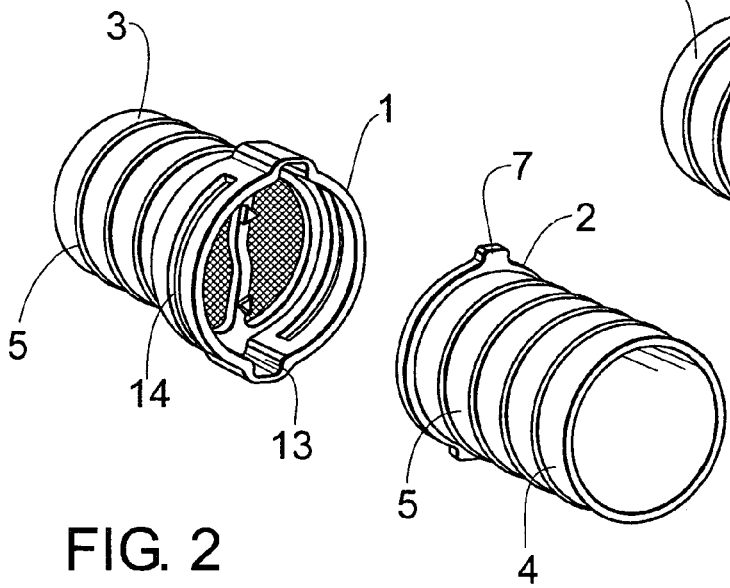
FIG. 2 shows the coupling elements of FIG. 1 aligned for coupling.

As can be seen from FIG. 2, when recesses 13 and lugs 7 are aligned, spigot element 2 can be inserted into socket element 1 whereby the respective end wall 8 and land 11 abut.

Figure 3:
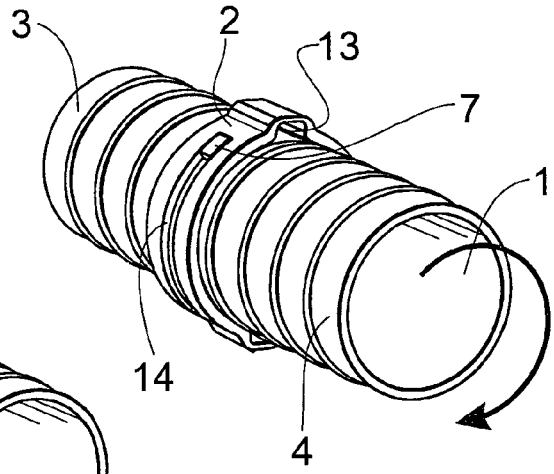
FIG. 3 shows the coupling elements of FIG. 1 in a coupled state.

FIG. 3 shows locking engagement between the socket and spigot element of FIGS. 1 and 2. As can be seen in FIG. 3, after socket 1 and spigot 2 are urged into axial alignment with respective land and end wall surfaces 11,8 abutting, the spigot 2 may be rotated clockwise relative to socket 1 whereby lugs 7 locate in respective slotted apertures and when rotated through about 150° lock the socket and spigot elements 1,2 together.

Figure 4:
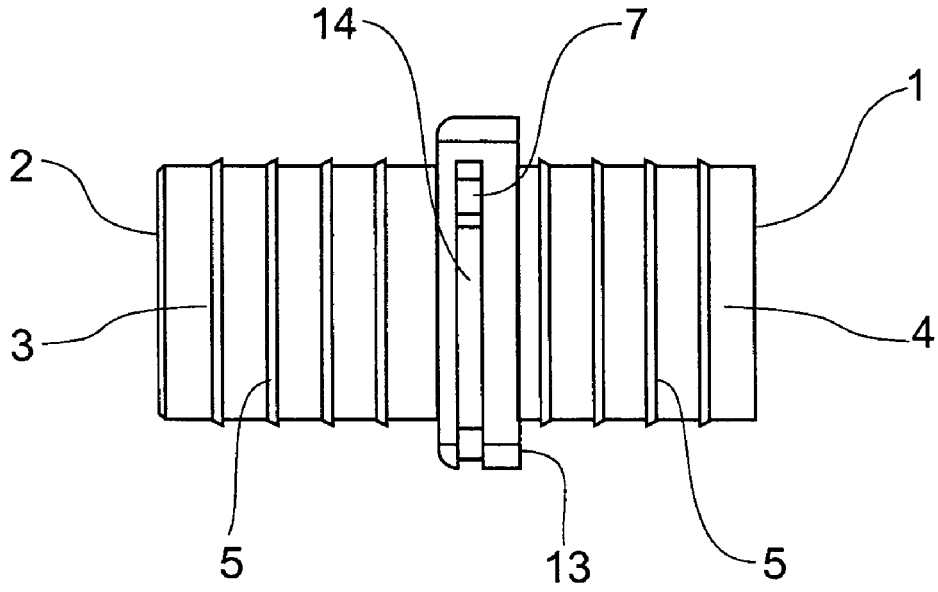
FIG. 4 is a side elevational view of the assembly of FIG. 3.

FIG. 4 is a cross-sectional view of the socket 1 and spigot 2 in locked coupling engagement.

Figure 5:
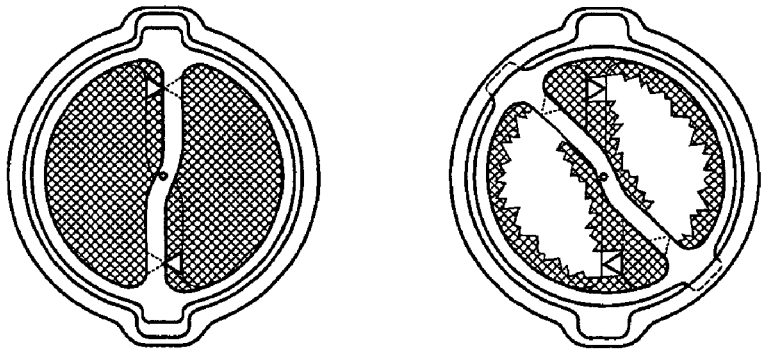
FIG. 5 shows cross-sectional views of the assembly of FIG. 3 and FIG. 4 before and after locking.

FIG. 5 shows cross-sectional views between socket and spigot elements 1,2 at the point of initial coupling and after relative rotation to a locked position as shown in FIGS. 3 and 4.

As shown, at the initial point of coupling, the perforating blades 10, which are diametrically offset due to the "S"-shaped ribs 8 perforate the membrane 15 of the opposite element as they are brought into abutment. The left hand figure shows the perforating blades 10 of socket element 1 emerging through the membrane 15 of spigot element 2 while the oppositely facing perforating blades 10 (shown in phantom) extend through the membrane 15 of socket member 1.

As the spigot member is rotated through about 150° as shown generally in FIG. 3, the opposing perforating blades 10 of spigot element 2, whilst rotating clockwise, present the broad blunt faces of the generally triangular shaped members to the perforated edge of the membrane where they tear large holes 16 in the membrane of the socket member 1 as they rotate. Similarly, as relative rotation occurs between spigot element 1 and socket element 2, the perforating blades 10 of socket element 1 tear large aligned holes 16 in the membrane of spigot element 2. The large torn holes rather than simple cut perforations permit intimate mingling of the explosive compositions on opposite sides of the membranes without gapping.

Figure 6:
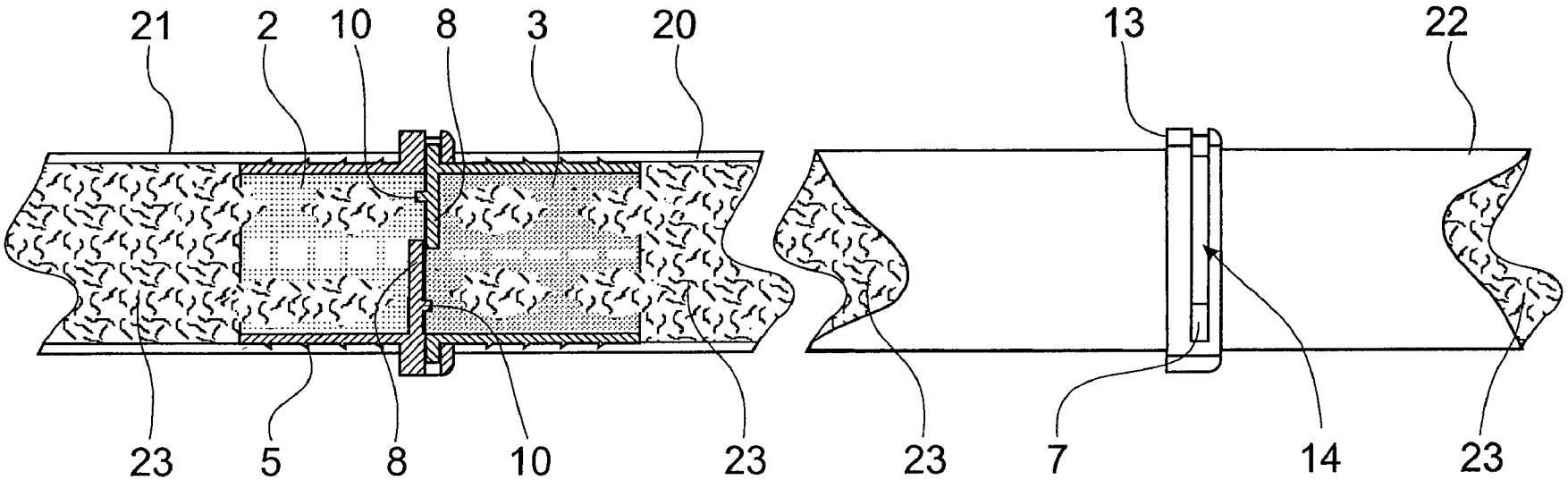
FIG. 6 shows a partial cross-sectional view of a modular tubular explosives cartridge according to an aspect of the invention.

FIG. 6 shows schematically a modular explosives cartridge 20 coupled to like cartridges 21,22 to achieve an elongate tubular explosives cartridge of any desired length simply by coupling like individual cartridges with the lockable coupling members according to the invention whereby a continuous column of explosive composition 23 is formed.

It readily will be apparent to a person skilled in the art that the modular explosives cartridge according to the invention provides a convenient form of packaging of explosives compositions to facilitate ease of storage and transportation as well as ease of installation of an explosives charge of a desired length without the danger and/or inconvenience of gapping as encountered in prior art modular explosives packaging systems.

FIGS. 7–11 illustrate an alternative embodiment which may be utilized in conjunction with the modular explosives cartridges according to the abovementioned aspects of the invention or any other elongate tubular explosives cartridge.

Figure 7:
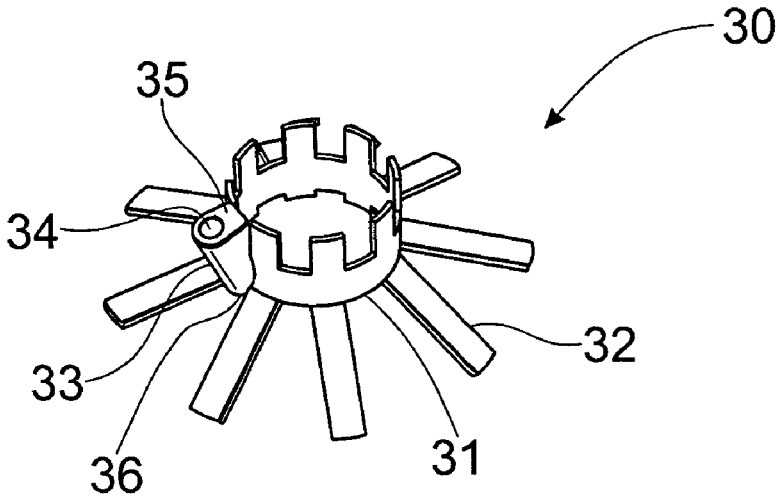
FIG. 7 shows an improved spider according to another aspect of the invention.

FIG. 7 shows a modified form of a conventional "spider" 30 normally employed to locate an elongate tubular explosives cartridge centrally of a borehole. The spider 30 comprises a circular band 31 with a plurality of generally radially extending fingers 32 extending therefrom. In use, spiders 30 are slipped over an elongate tubular explosives cartridge (as shown generally in FIGS. 9 and 10) and are located at a desired spacing along the cartridge. As the cartridge is inserted into a borehole, the fingers 32, having an outer diameter greater than the diameter of the borehole, fold rearwardly and the resilient restoring force therein retains the band 31 and thus the cartridge generally centrally of the borehole.

While generally effective fort heir intended use, prior art spiders generally are used only with elongate explosive cartridges of the type described in PCT/AU99/00134 to the same inventor. Such elongate cartridges employ an internal detonating cord which extends to a distal end of the tubular explosives package where a primer or enlarged diameter body of explosive composition is located.

In the blasting of stope walls and/or rooves, it would be desirable to facilitate a progressive blasting sequence within a borehole with, say a sequential detonation commencing near the borehole mouth and progressing towards the blind end of the borehole for a more efficient blasting of the rock formation.

Sequential blasting in a single borehole utilizing a unitary elongate tubular charge such as that described in PCT/AU99/00134 or a modular elongate tubular charge as described above may be effected by the modified spider of FIG. 7.

As shown in FIG. 7 integrally formed with the plastics spider moulding is a protruding body 33 having an elongate aperture 34 extending between upper and lower walls 35,36 of body 33, the aperture being generally cylindrical in shape and having an elongate central axis inclined inwardly at its lower end relative to a longitudinal axis of a tubular charge to which it may be attached.

Figure 8:
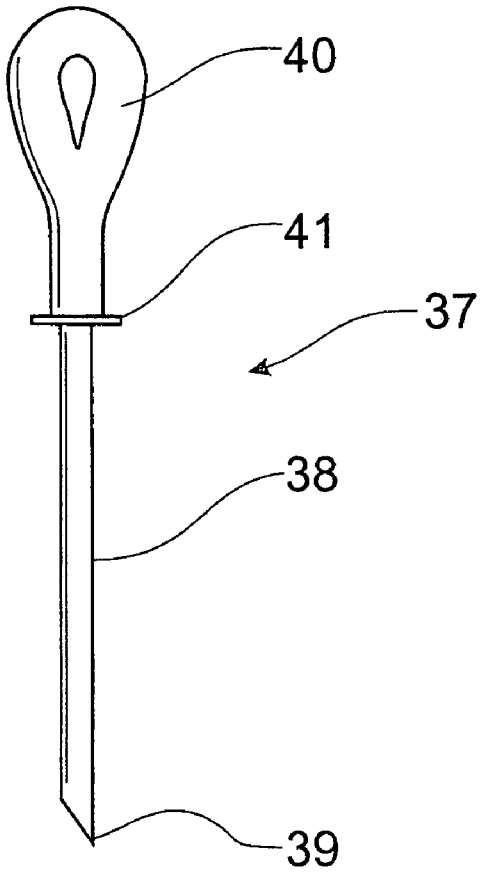
FIG. 8 shows a penetration tool for use with the spider of FIG. 6.

FIG. 8 shows a piercing tool 37 for use with the spider 30 of FIG. 7.

Tool 37 comprises a hollow thin walled steel tube body 38 having a pointed tapered end 39 and a handle 40 remote from pointed end 39. A depth gauge in the form of a collar 41 limits the extent to which the tubular body 38 may be extended through aperture 34.

Figure 9:
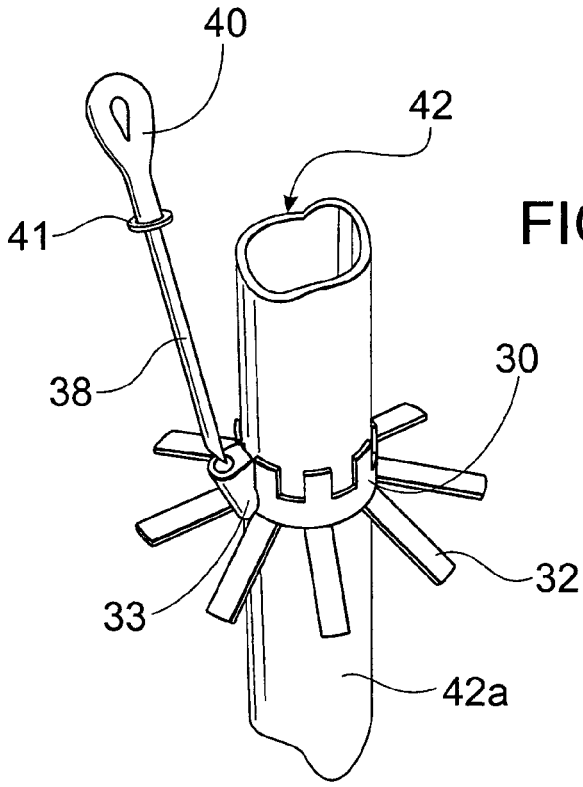
FIG. 9 shows the use of the penetration tool of FIG. 7 with the spider of FIG. 6.
Figure 10:
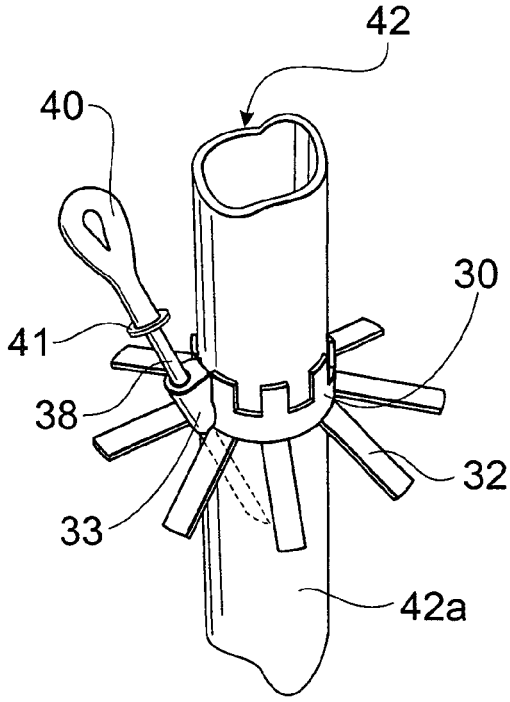
FIG. 10 shows a part cut-away view of the assembly of FIG. 8 when penetrated.
Figure 11:
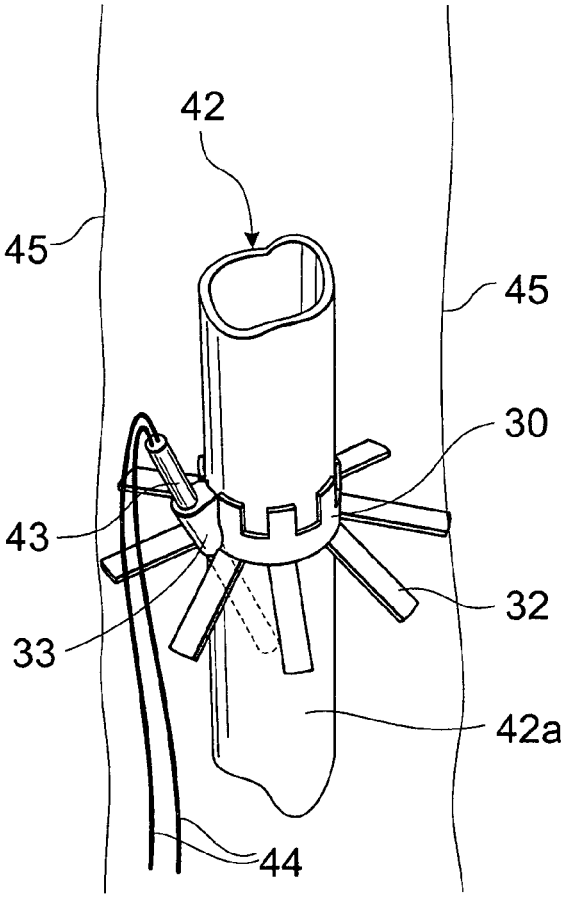
FIG. 11 shows an in situ location of a detonator in the spider of FIG. 6.
Figure 4:
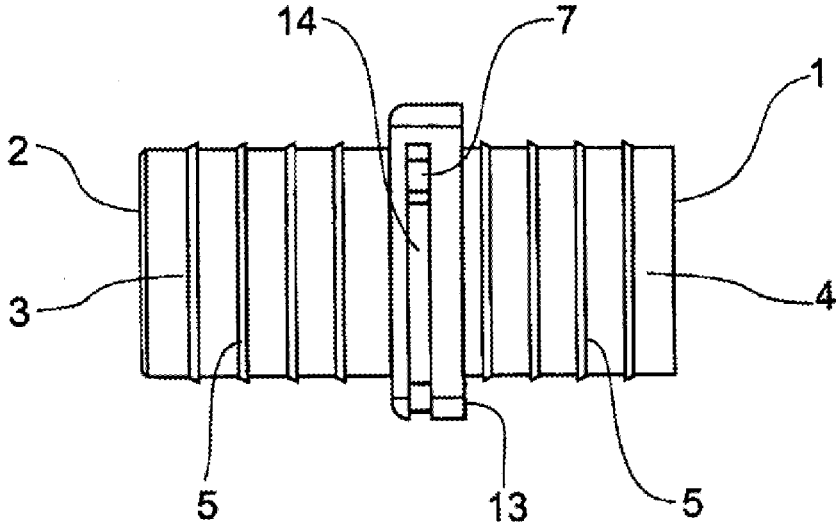
Figure 5:
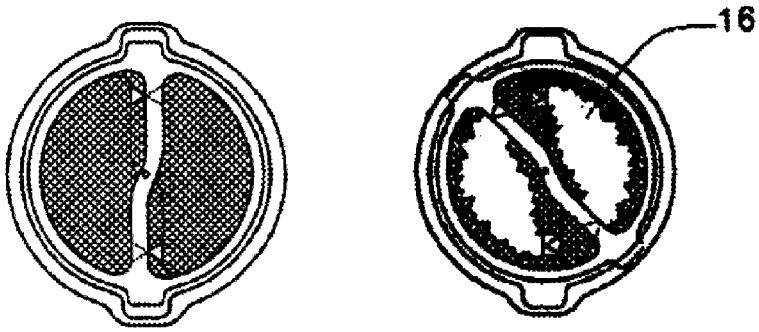

In use, as shown in FIGS. 9 and 10, tool 37 is initially located in aperture 34 of spider 30 located about an elongate explosives cartridge body 42 with the sharpened point 39 resting against the wall of cartridge body 42. By pushing down on handle 40, the sharp end 39 of tool 37 pierces the plastics wall 42*a* of body 42 and extends into the interior of body 42 to an extent limited by depth gauge 41. As shown partially in phantom in FIG. 10, the tubular body 38 of tool 37 is partially filled with explosive composition as the tool is inserted and when the tool is removed an inclined cylindrical aperture is left in the explosive composition.

A detonator 43 is then inserted into the hollow aperture 34 of spider 30 which guides the detonator into the cylindrical aperture created in the explosives composition after tool 37 is removed. The aperture 34 of spider 30 provides a firm frictional fit for detonator 43 and, in effect, acts as an integrally formed cap well with the spider 30. A detonation cord or cords 33 coupled to detonator 43 trails downwardly to the mouth of the borehole 45 and thence to a detonating device.

By spacing the spiders according to this further aspect of the invention at appropriate distances along an elongate tubular explosives charge, each having a respective detonator located in the cap well formation on the spider, sequential blasting in a single borehole with a single explosives charge is facilitated.

Again, it readily will be appreciated by a person skilled in the art that the advantages offered by the modified spider according to the invention include substantial cost savings arising from a more convenient and less labour intensive procedure for charging a borehole with elongate tubular explosives charges.

The invention claimed is:

1. A modular explosives cartridge, said cartridge comprising:

a tubular body having lockable coupling members secured on opposite ends thereof, said lockable coupling members comprising a socket member secured at one end of the tubular body and a spigot member secured at an opposing end of the tubular body, said lockable coupling members each including at least one piercing member and a sealing membrane to form a sealed closure at opposite ends of said body to an explosive composition contained within said tubular body, each said lockable coupling member, in use, being adapted to releasably engage with a respective lockable coupling member of a like explosives cartridge whereby adjacent sealing membranes of respective coupling members are pierced during coupling of adjacent cartridges to form a continuous column of explosive composition in an elongate explosive charge extending between opposite ends of coupled explosives cartridges.

2. An explosives cartridge as claimed in claim 1 wherein said at least one piercing member comprises an axially extending blade.

3. An explosives cartridge as claimed in claim 1 wherein said coupling members are secured to said tubular body by fusion or by an adhesive composition.

4. An explosives cartridge as claimed in claim 1 wherein said coupling members are identified by visual identifiers to assist in manufacture of and subsequent coupling of said modular explosives cartridges.

5. An explosives cartridge as claimed in claim 4 wherein said identifiers comprise colour coding of said coupling members.

6. An elongate tubular explosives charge comprising a plurality of coupled modular explosives cartridges according to claim 1.

7. An elongate tubular explosives charge according to claim 6 including a spider for locating said elongate tubular explosives charge in a borehole, said spider comprising:

a mounting collar, in use securable about an outer surface of an elongate tubular explosives charge, said mounting collar supporting a plurality of spaced substantially radially extending fingers, said fingers, in use, being resiliently deformable to accomodate a borehole having a diameter greater than said elongate tubular explosives charge and smaller than a diameter of said radially extending fingers in an undeformed state; and, a hollow locator body supported on said mounting collar to locate, in use, a detonator extending partially via an aperture in a wall of said explosives charge to an interior region occupied by an explosives composition.

8. An elongate tubular explosives charge as claimed in claim 7 wherein said mounting collar comprises a circular member slidably securable over an outer surface of said elongate tubular explosives charge, said mounting collar, in use, being anchored to said elongate tubular explosives charge by engagement of said detonator extending into said interior region of said charge.

9. An elongate tubular explosives charge as claimed in claim 7 wherein said hollow locator body has a tubular axis extending, in use, at an acute angle with a longitudinal axis of said elongate tubular explosives charge.

10. An elongate tubular explosives charge as claimed in claim 7 wherein said hollow locator body, in use, comprises a guide to facilitate alignment of a piercing tool to form an aperture in a wall of said explosives charge.

11. An elongate tubular explosives charge as claimed in claim 10 wherein said piercing tool is adapted, in use, to form a detonator locating cavity in said explosives composition.

12. A modular explosives cartridge, said cartridge comprising:

a tubular body housing an explosive composition and extending between a first end and an opposing second end, a spigot member secured at said first end of said tubular body and a socket member secured at said second end of said tubular body, said spigot member and said socket member each comprising at least one piercing member and a sealing membrane, said spigot member being adapted to couple with a socket member of a like explosives cartridge such that when said spigot member couples with the socket member of the like explosives cartridge said at least one piercing member of said spigot member pierces the sealing membrane of the socket member and the at least one piercing member of the socket member pierces said membrane of said spigot member.

* * * * *

UNITED STATES PATENT AND TRADEMARK OFFICE

CERTIFICATE OF CORRECTION

PATENT NO. : 7,210,409 B2
APPLICATION NO. : 10/769033
DATED : May 1, 2007
INVENTOR(S) : Richard John Johnson It is certified that error appears in the above-identified patent and that said Letters Patent is hereby corrected as shown below:

Drawings

Delete Fig. 5 and replace with Fig. 5 as shown.
Sheet 2, replace fig. 5 with the figure depicted herein below, wherein the label "16" has been added.

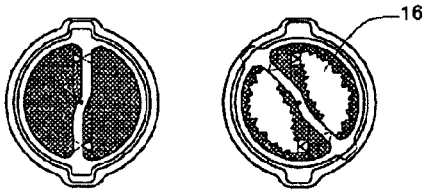

FIG. 5

Column 2

Line 48, between "due" and "gapping", add --to--
Line 55, after "this", add --is--

Column 5

Line 13, change "FIG. 6" to --FIG. 7--
Line 14, change "FIG. 7" to --FIG. 8--
Line 15, change "FIG. 6" to --FIG. 7--
Line 17, change "FIG. 8" to --FIG. 9--
Line 19, change "FIG. 6" to --FIG. 7--

UNITED STATES PATENT AND TRADEMARK OFFICE

CERTIFICATE OF CORRECTION

PATENT NO. : 7,210,409 B2
APPLICATION NO. : 10/769033
DATED : May 1, 2007
INVENTOR(S) : Richard John Johnson It is certified that error appears in the above-identified patent and that said Letters Patent is hereby corrected as shown below:

Column 6

Line 21, change "FIG. 3" to --FIG. 5--
Line 64, change "fort heir" to --for their--

Signed and Sealed this

Twelfth Day of February, 2008

JON W. DUDAS
*Director of the United States Patent and Trademark Office*